US008989420B1

(12) United States Patent
Hamer et al.

(10) Patent No.: US 8,989,420 B1
(45) Date of Patent: Mar. 24, 2015

(54) THROWABLE WIRELESS MICROPHONE SYSTEM FOR PASSING FROM ONE USER TO THE NEXT IN LECTURE ROOMS AND AUDITORIUMS

(75) Inventors: Joseph Andrew Hamer, Northbrook, IL (US); Jacob Robert Ragins, Deerfield, IL (US); Alan Richard Mellovitz, Deerfield, IL (US)

(73) Assignee: Engagement Innovations LLC, Deerfield, IL (US)

( * ) Notice: Subject to any disclaimer, the term of this patent is extended or adjusted under 35 U.S.C. 154(b) by 721 days.

(21) Appl. No.: 13/093,282

(22) Filed: Apr. 25, 2011

Related U.S. Application Data

(60) Provisional application No. 61/328,012, filed on Apr. 26, 2010.

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |

(52) U.S. Cl.
USPC ..... 381/355; 381/122; 381/189; 381/368; 381/77

(58) Field of Classification Search
CPC ..... H04R 19/04; H04R 2420/07; H04R 1/04; H04R 5/027; H04R 1/02; H04R 2410/00; H04R 9/08; H04R 3/007
USPC ..... 381/77, 122, 355, 189, 368
See application file for complete search history.

(56) References Cited

U.S. PATENT DOCUMENTS

| | | | | |
|---|---|---|---|---|
| 5,102,131 | A | 4/1992 | Remington | |
| 6,387,022 | B1 | 5/2002 | Smith | |
| 7,007,290 | B2 | 2/2006 | Wilcoxson et al. | |
| 2006/0183576 | A1 * | 8/2006 | Lindsey et al. | 473/570 |
| 2010/0093412 | A1 * | 4/2010 | Serra et al. | 455/575.8 |
| 2010/0291880 | A1 * | 11/2010 | Feldstein | 455/73 |
| 2013/0250047 | A1 | 9/2013 | Hollinger | |

FOREIGN PATENT DOCUMENTS

| | | | |
|---|---|---|---|
| EP | 0103666 | A1 | 3/1984 |

* cited by examiner

*Primary Examiner* — Paul S Kim
(74) *Attorney, Agent, or Firm* — Patzik, Frank & Samotny Ltd.

(57) ABSTRACT

A wireless microphone system within an enclosure for use in lecture hall sound systems that enables facilitated passing of the system from one user to another and provides a less intimidating microphone configuration to grip and use than standard wireless microphones. The system can also include an integrated push-to-talk feature requiring activation before a user's comments will be picked up and amplified over the sound system. The system can also include a laser pointer allowing the user to reference objects while they speak into the device. A wireless mute button can also be provided so that the lecturer or discussion leader can control when the system will be operative. The audio transmitter can be substituted with a audio recorder to be used independently of an audio receiving system.

19 Claims, 5 Drawing Sheets

THROWABLE WIRELESS MICROPHONE SYSTEM FOR PASSING FROM ONE USER TO THE NEXT IN LECTURE ROOMS AND AUDITORIUMS

CROSS-REFERENCES TO RELATED APPLICATIONS

This application claims the benefit of U.S. provisional application No. 61/328,012, filed on Apr. 26, 2010, the entirety of which is hereby incorporated by reference.

The invention relates to wireless microphones in general and in particular to a foam enclosed wireless microphone system and for use with typical speaker systems in a lecture hall, classroom, auditorium-like room or the like to facilitate passing of the microphone and use thereof by multiple people in the audience.

SUMMARY OF THE INVENTION

Currently, wireless microphones used in college lecture halls or the like are intimidating to use for many people and take a long time to pass from one user to another during a class or lecture. Accordingly, many people are afraid or at least reluctant to use a microphone in front of a large group and do not participate or ask questions, the answers to which could benefit many. Likewise, much time is lost in lectures or classes passing standard batton-like microphones around the large room.

Accordingly, one object of the present invention is to provide a passable microphone system that is not intimidating and can be passed easily, safely and quickly around a large room—by throwing it from one user to another, as desired.

This invention can include a wireless microphone transmitter or recorder enclosed inside of and surrounded by a durable, easily hand-held object, which has an outer durable skin or cover portion such as vinyl or plastic and a foam-like or cushion-like, resilient inner core material to enable gripping and throwing of the object within the room from person to person, while preventing damage to the transmitter or injury to the person that may be hit by the object. Throughout this application, the object shall be referred to as the "mic ball". It could be filled with loose or solid foam material like a pillow. Alternatively, the enclosure can be like an inflatable beach ball, with a sealed chamber or compartment that resealably receives the wireless microphone unit therein.

The shape of the object can be round, oblong like a football, square or virtually any other shape. The holder of the object can choose to speak into the object, which is wirelessly linked to the receiver of an audio system (and or teleconferencing device), or to pass it on to someone else who does want to use the microphone to speak. The wireless microphone is replaceable through an opening in the object and can be powered by either disposable batteries, rechargeable batteries or any other means of alternative local or portable power generation.

The cover or skin of the object is durable enough in that it can be tossed around from user to user without compromising the efficiency or operation of the microphone transmission or the product, as a whole. Optimally, the cover should be smooth and washable. While it should have a texture that makes it easy to hold, it should not be abrasive. The cover must also have enough durability and elasticity to be capable of being sewn or otherwise made to adhere to surface mounted components such as lights, buttons or the like.

The professor, lecturer or host in the auditorium is able to wirelessly (or via classroom computer) control the mic ball by muting (or performing other desired functions such as raising or lowering volume) one or several mic balls in the audience from a handheld device. By doing so, one can prevent or cut short use of the mic ball, or amplify and transmit statements to the speaker system for broadcast throughout the room or elsewhere outside the room as permitted by the wireless sound system. In addition, the exterior will consist of a sanitary or washable material and due to the foam interior, the electronics will not be damaged or compromised during portability. The safety of all members in the audience is not compromised because of the sanitary concerns, sufficient padding surrounding electronics, and protection from sharp objects such as the zipper.

This device can be utilized in places where traditional wireless microphones are used with portable or built-in sound systems such as classrooms, auditoriums, conference rooms, theatres, etc. It is intended to act as a convenient means of integrating multiple people over the transmission of an audio system. The cover and foam insert of the present invention is meant to retrofit a conventional belt pack and clip style of traditional wireless microphone/receiver units of wireless speaker systems. This device can also be utilized as means of audio recording to compliment video capturing systems in classrooms, auditoriums, conference rooms, theaters, etc. The device replaces and/or can be used in conjunction with traditional handheld, ceiling suspended lavalieres, built-in camera microphones, etc for the purposes of capturing small to large audience verbal responses.

This invention is an innovative tool that can encourage audience participation by eliminating the necessity to raise one's voice in a large room in order to be heard. The device can be conveniently and safely tossed around from one user to the next, unlike the current conventional wireless microphone to save wasted time between questions asked. As a result of this physically engaging activity, individuals in the audience will be further encouraged to participate in discussions or ask questions.

One embodiment of the present invention comprises a throwable microphone unit including a wireless audio transmitting device, adapted for use in a lecture hall, classroom, or auditorium to amplify what the user is saying. An outer enclosure having an interior for substantially surrounding and operably protecting the wireless audio transmitting device therewithin, serves to keep the transmitting device from being operationally affected by physical impact when the unit is thrown around, hits an object or is dropped.

The interior of the enclosure is operably associated with the transmitting device within the enclosure. Controls operably associated with the transmitting device allow users to interact with the transmitting device from the exterior of the enclosure. The enclosure and the wireless audio transmitting device provide for facilitated transfer of the enclosure and the device from user to user.

The invention can alternatively include a wireless controller operably associated with the unit for someone other than the user to selectively, remotely activate and deactivate the transmitting device. in addition the invention can alternatively include one or more of the following items: an audio recorder for recording of the comments of the user (with or without transmitting what the user is saying to a loudspeaker system); an RF mute button operably associated with said transmitting device: voice activated transmission of the transmission device; an RFID security tag; a laser pointer; use of rechargeable batteries; a non-round enclosure shape; and surface mounted display and controls.

The invention can be used in the following way as shown in FIGS. 1 through 8 herein:

1) User obtains a belt pack wireless microphone unit or audio recording device 13 with the microphone 21 attached;

2) User takes the microphone clip off of the microphone 21 and detaches the microphone from the connector 22 on belt pack unit 13;

3) The user will slide the microphone 21 into the bushing 18 and tighten the three Allen-head set screws 19, 20, 20A. The bushing 18 is inserted and rotates 60 degrees clockwise into the clip-fastener 17 until a compress fit is achieved between clip-fastener 17 and busing 18 shown in FIG. 6. Clip-fastener 17 is sewn or otherwise securely fastened to shell 11.

4) Buttons 50, 52, and laser 55 are inserted into button-rings 51, 53 and laser ring 54 respectively. Button rings 51, 53 and laser ring 54 are sewn or otherwise fastened to shell 11.

5) Microphone and button wires are fed through bore holes in ball 23. The shell 11 is then applied over ball 23.

6) The microphone wire is fed through the bore hole 15, and is hardwired to the push to talk button 50. The male end of mic ball's internal electronics is connected to the belt pack 13 via connector 22. Antenna wire 14 is attached to the belt pack unit 13 or antenna wire 14 will already be sewn into or placed alongside the shell 11 of the ball 10 to increase wireless signal strength;

7) Belt pack unit 13 is slid into ball 23, compartment 40 and the zipper 12 is closed. A hook and loop type fastener strip (not shown) such as Velcro® can be used instead of or in addition to the zipper 12 to protect users from zipper 12;

8) For replacement purposes, the user can remove and replace skin 11 as well as release bushing 18 from clip-fastener 17 to remove and replace microphone 21. The inside diameter of the bushing 18 is wide enough to fit any standard wireless microphone component 21.

Variations of the invention include the following:

1) Voice-Activated Push-to-Talk Button: Utilizes voice-activated accessory to establish a signal.

2) Manual Push-to-Talk: Exterior button (with possible indicator light) used to establish a signal.

3) Lecturer disable button: Handheld RF Transmitter to disengage the audio transmission. (This option will be available for all variations) In FIG. 8, RF receiver 74 intercepts the audio signal from microphone receiver 72 into audio mixer 78 and amplified speaker 79. The hand-help transmitter 76 engages or disengages the signal pass-through of receiver 74, thus enabling or disabling the audio transmission of the mic ball.

4) Integrated microphone: Individual microphone attaches to 4-pin connector of the belt pack 13 (not included). Individual must supply belt pack. Microphone 21 is therefore permanently fastened by methods not illustrated in drawings 1 through 8.

5) Integrated circuitry: Reconfigure belt pack or audio recording circuitry and extract the internal circuitry to place inside mic ball's foam enclosure 23. This would decrease weight and create a user-friendly setup. The belt pack controls and display would be mounted to the face of the mic ball. In FIG. 8 the display and controls 70 are hardwired to belt pack 13 and mounted on the surface of shell 11. Mounting display and controls 70 are not illustrated on FIGS. 1-8.

6) Enclosure only: Invention is compatible and able to retrofit any wireless microphone belt pack unit on the market. Individual must supply both the microphone and belt pack unit. In order to control the belt pack unit, such as changing the channel and switching power, the user must remove the pack from the zippered enclosure. Note this variation is illustrated in FIGS. 1-8.

7) Audio Recording: Replacing belt pack 13 with audio recording device to seize the dependency on a wireless audio system. The audio recording device 13 connects to microphone 21 and button 50 the same way illustrated in FIG. 8.

Alternatives for the battery include:

1) Retrofit circuitry in order to use rechargeable batteries of a higher voltage (9 v-10 v). Location of batteries within the device can be strategically placed to create an optimal weight distribution;

2) Use regular alkaline batteries and replace them when necessary;

Other alternatives include:

Some microphone clips are designed with a mute option, and it is always transmitting a signal (8 hour battery life) as soon as the device is turned on. The belt pack 13 circuitry could be adapted so that it is not transmitting until push to talk is active so as to conserve battery life.

The laser pointer can be used to enable the user of the device to point out specific portions of what is being displayed by the instructor or lecturer. A Radio Frequency Identification ("RFID") implant can be included for tracking the device and/or setting off an alarm, silent or otherwise, if the unit is removed from the permitted area. The RFID sensor can also be used to identify on a computer screen or the like, the location of the user or holder of the device. Lights may also be included on the device which would light up and/or flash to draw attention to the user of the device.

The exterior shell or cover 11 should be a sanitary, vinyl the like. The interior 23 should be a shock absorbing, semi-rigid foam-like material that protects the electronics.

The foregoing objectives and others should become clear after reviewing the drawings.

DETAILED DESCRIPTION OF THE DRAWINGS

Figure 1:
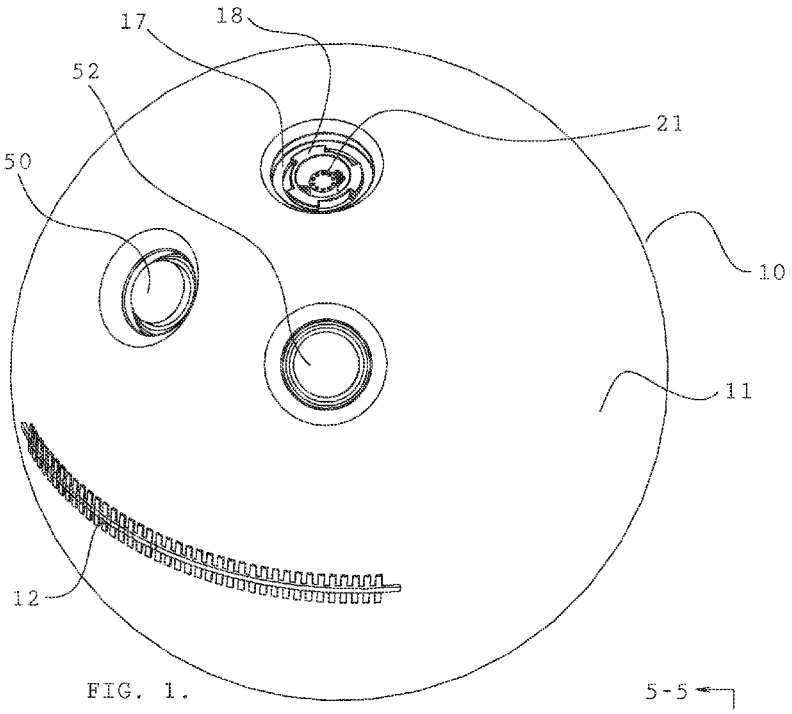
FIG. 1 is an isometric view of the mic ball 10.

FIG. 1 illustrates an isometric view of the mic ball including microphone 21, busing 18, clip fastener 17, push to talk button 50, laser button 52, zipper 12 and shell 11.

Figure 2:
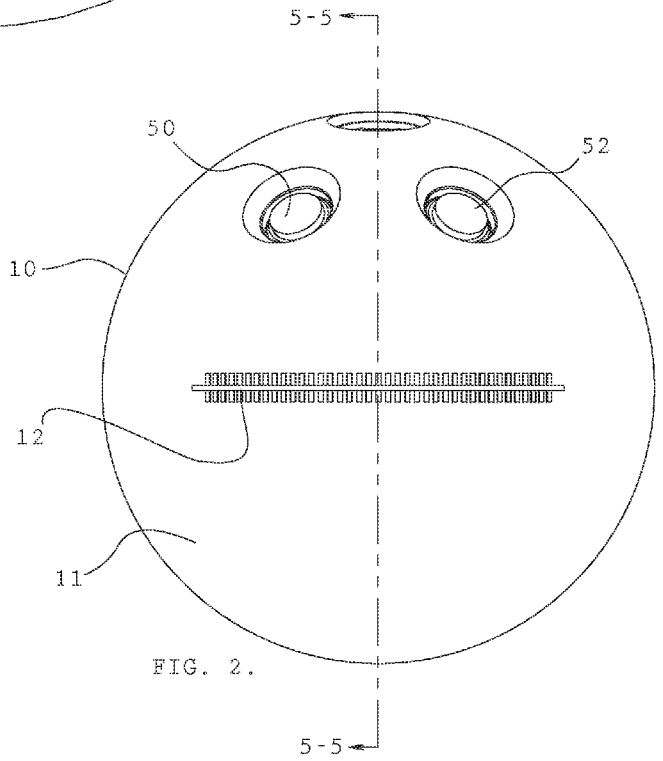
FIG. 2 is a front elevation view of mic ball 10 showing line 5-5.

FIG. 2 illustrates a front view of the mic ball, noting section 5-5.

Figure 3:
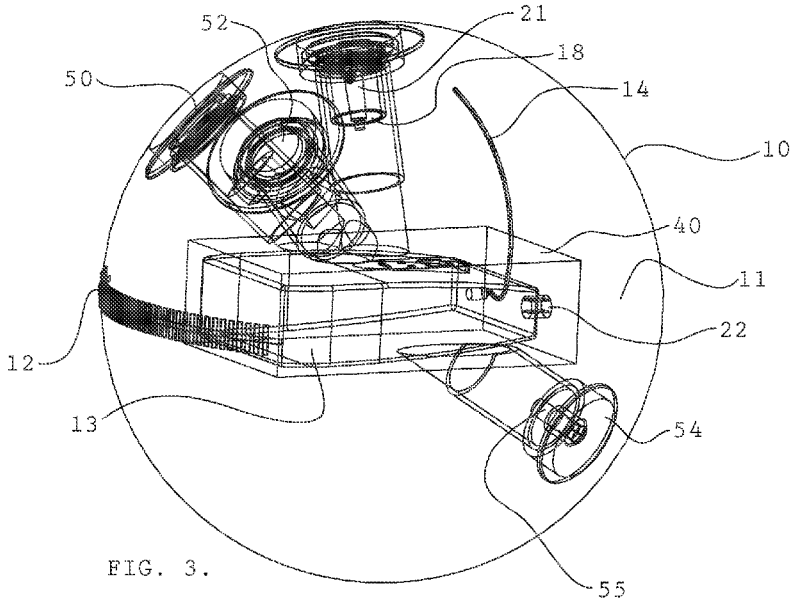
FIG. 3 is a transparent outline view of mic ball 10 surrounded by shell 11.

FIG. 3 illustrates the a transparent outline view of the final assembly configuration including belt clip unit 13 contained in compartment 40, four pin connector 22, antenna 14, zipper 12 and bushing assembly 6 containing microphone 21, talk button 50, laser button 52 and laser 55 within ring 54. The mic ball assembly is enclosed in shell 11.

Figure 4:
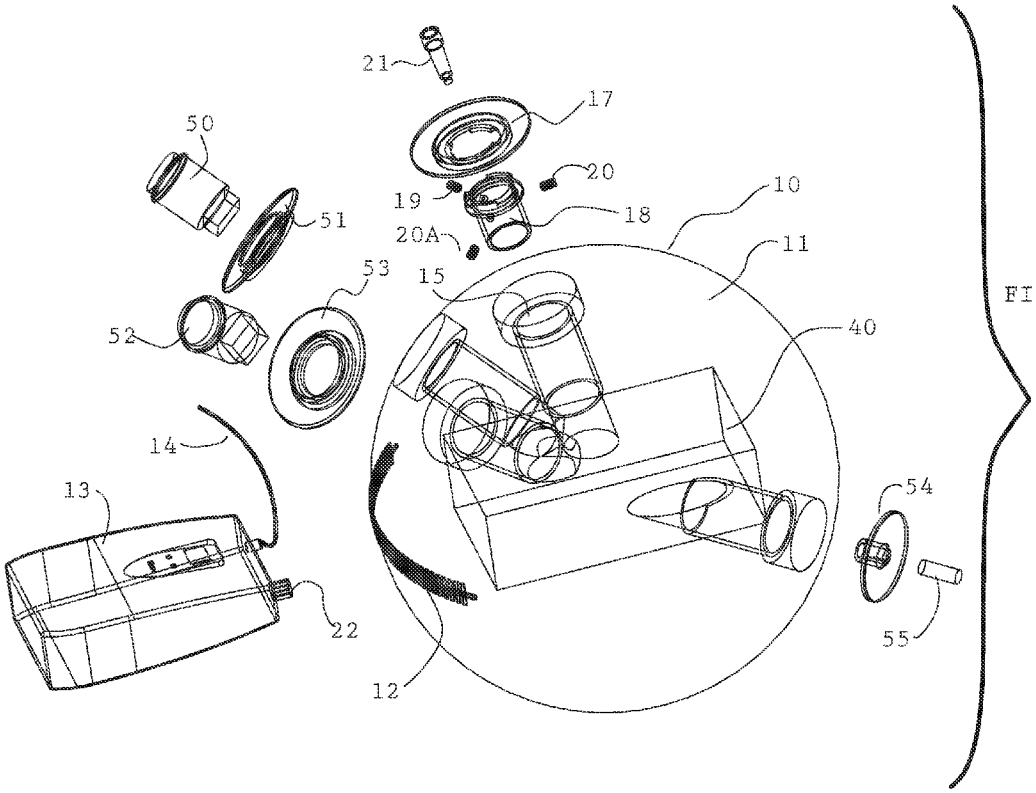
FIG. 4 an exploded transparent outline view of mic ball 10 showing microphone unit 13 outside of shell 11.

FIG. 4 is an exploded view of the wireless microphone belt clip unit 13 outside of mic ball shell 11 comprising wireless microphone belt clip or audio recorder unit 13, four pin connector 22, shell 11, zipper 12, hole 15, compartment 40, clip fastener 17, antenna 14, bushing 18, allen screws 19, 20, 20A. Also shown are push to talk button 50 and button ring 51, as well as laser (on-off) button 52 and laser ring 53. Also shown are laser 55 and laser ring 54.

Both push to talk button 50 and laser button 52 clip into button ring 53 and laser ring 54. Rings 53 and 54 are sandwiched between surface 11 and foam 23 or otherwise fastened. Laser 55 is pre-fitted into laser ring 54 with laser ring 54 sandwiched or otherwise fastened between surface 11 and foam 23.

Figure 5:
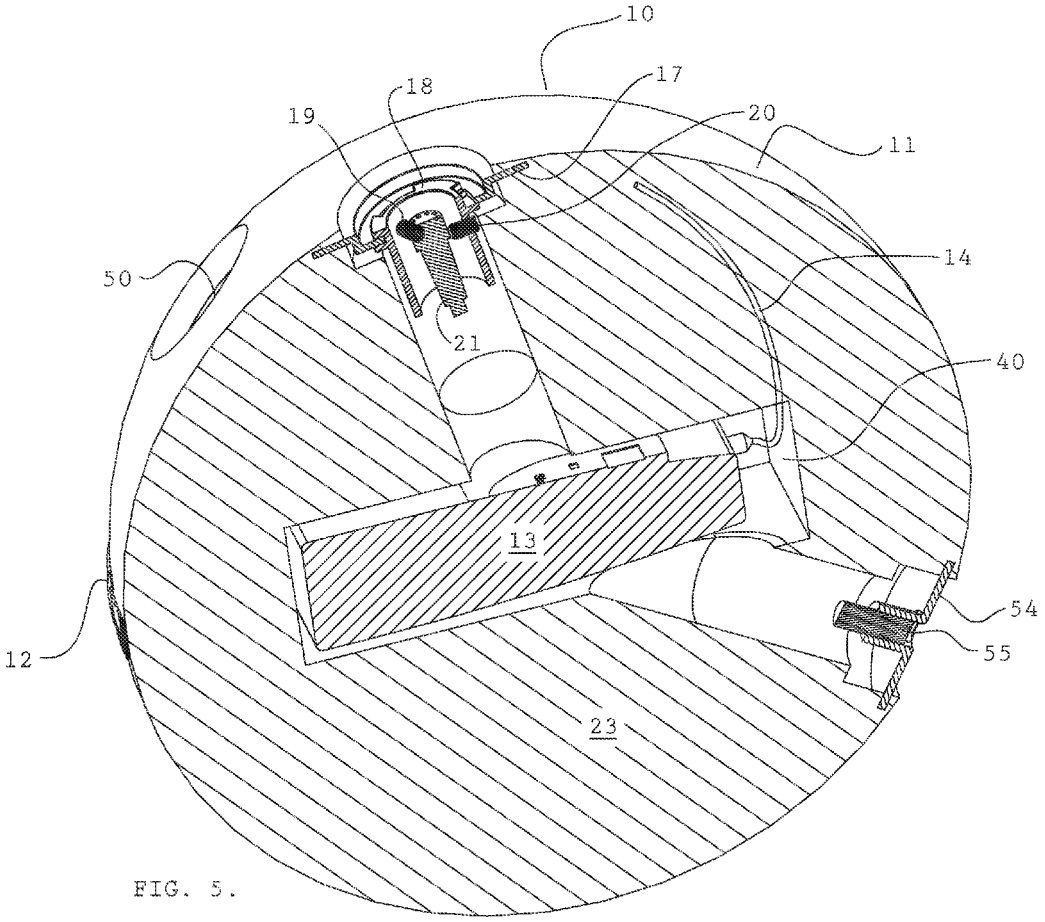
FIG. 5 is a cross-sectional view of mic ball 10 taken along line 5-5 of FIG. 2 and in the direction of the arrows.

FIG. 5 is cross section 5-5 denoted in FIG. 2. As shown in FIG. 5, cover 11 surrounds core 23 with wireless belt clip or recorder unit 13, having antenna 14, received within central compartment 40. Zipper 12 on cover 11 provides access to central compartment 40. Clip-fastener 17 and laser ring 54 are fastened between foam 23 and skin 11. Microphone 21 is secured in busing 18 by set screws 19 and 20.

One type of wireless microphone unit that can be used in the present invention is the Shure (R) Model ULX1J1. Its specs include; a rechargeable or Alkaline 9 volt battery that can have a 8-9 hour battery life; 1400 User-programmable channels; a TAF4 4-pin Mini Connector; a 25 dB gain adjustment knob; a mute switch; a wire type antenna; a size of 3.68"H×2.68"W×1.10"D; and a weight of 2.8 oz. The invention contemplates use of such a wireless microphone unit so as to be compatible with the most common type of audio amplification system employing speakers already installed in most lecture rooms, auditoriums etc. Alternatively the invention can be used with portable speaker systems compatible with wireless microphone systems.

One type of audio recording device that can be used in the present invention is the Olympus® Model VN-5000. Its specs include; 512 MB flash memory allowing for 20 hours of audio recording, a 3.5 mm mini-jack for the microphone, two AAA alkaline or NiMH batteries yielding 22-39 hours of battery life; a size 4.0×1.4×0.8 in. 2.2 oz.

Figure 6:
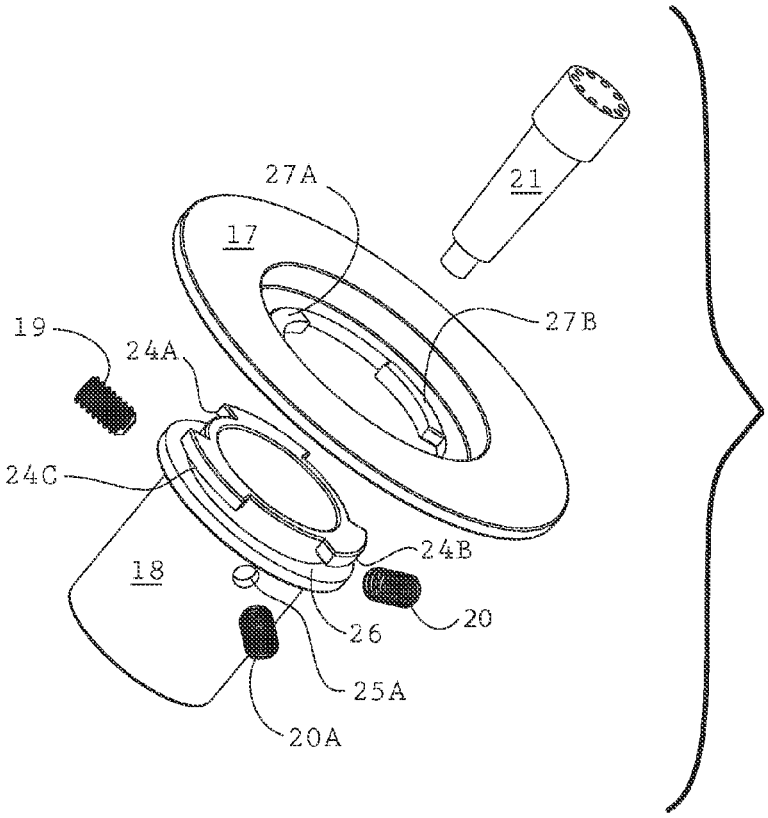
FIG. 6 is an exploded perspective view of the microphone assembly comprising microphone 21, clip fastener 17, bushing 18, and set screws 19, 20, 20A.
Figure 7:
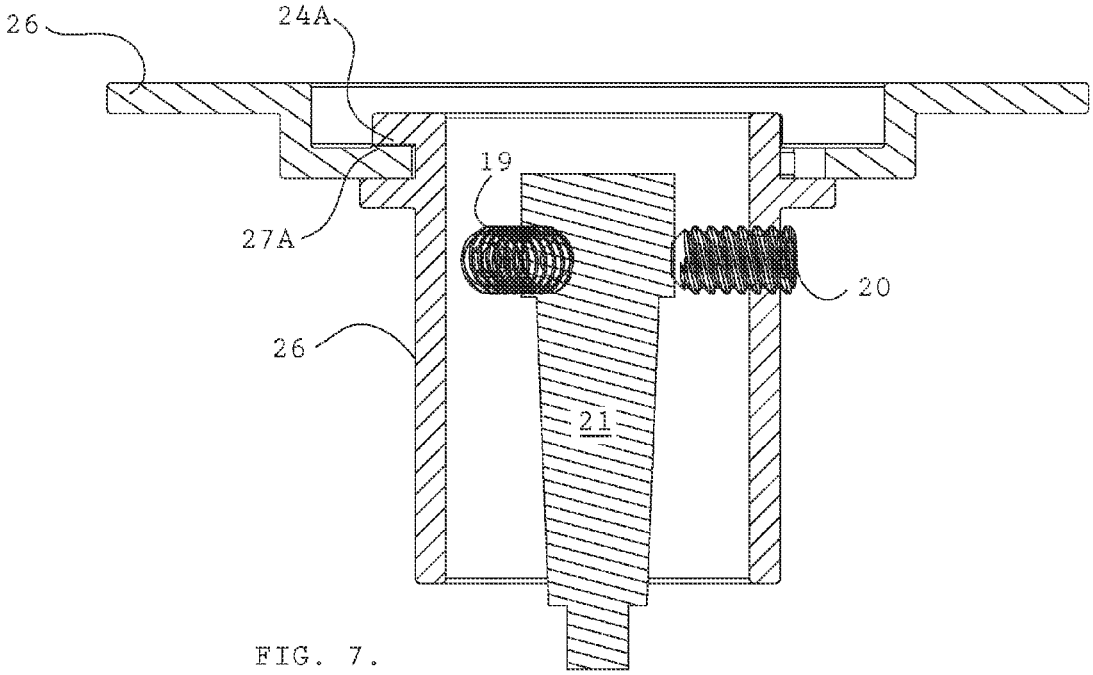
FIG. 7 is a cross-sectional view of the microphone assembly of FIG. 6 taken along the axis 5-5 of FIG. 2 and in the direction of the arrows.

FIG. 6 illustrates the assembly of microphone 21, clip fastener 17, busing 18, and set screws 19, 20, 20A. FIG. 7 shows the cross section of assembly 6 indicated by 5-5 in FIG. 2. As shown in FIGS. 6 and 7, Microphone 21 is held within bushing 18 by set screws 19, 20 and 20A within holes 25C, 25B and 25A. Tabs 24A, 24B and 24C of bushing 18 are shown in FIG. 6 and serve to detachably hold bushing 18 by inserting bushing 18 from the back side of clip fastener 17 and rotating clockwise until a compressed fit is achieved (about 20 degrees clockwise).

As shown in FIG. 6, bushing 18 is concentrically aligned with clip 17 as well as hole 15 and rotationally aligned such that tabs 24A, 24B, 24C will clear tabs 27A, 27B of clip fastener 17. Tabs 24A, 24B and 24C of bushing 18 and tabs 27A and 27B of bushing 18 have an incline to achieve a compression fit once the bushing is rotated clockwise about 20 degrees into assembly position. Lower rim 26 of bushing 18 is sized to be larger than the opening in clip 17. If the user would like to replace, access or remove microphone 21, vinyl cover 11 is removed and bushing 18 should be rotated counter-clockwise about 20 degrees and removed from clip fastener 17. Similar arrangements for easy removal can be provided on buttons 50 and 52 or laser 55.

Figure 8:
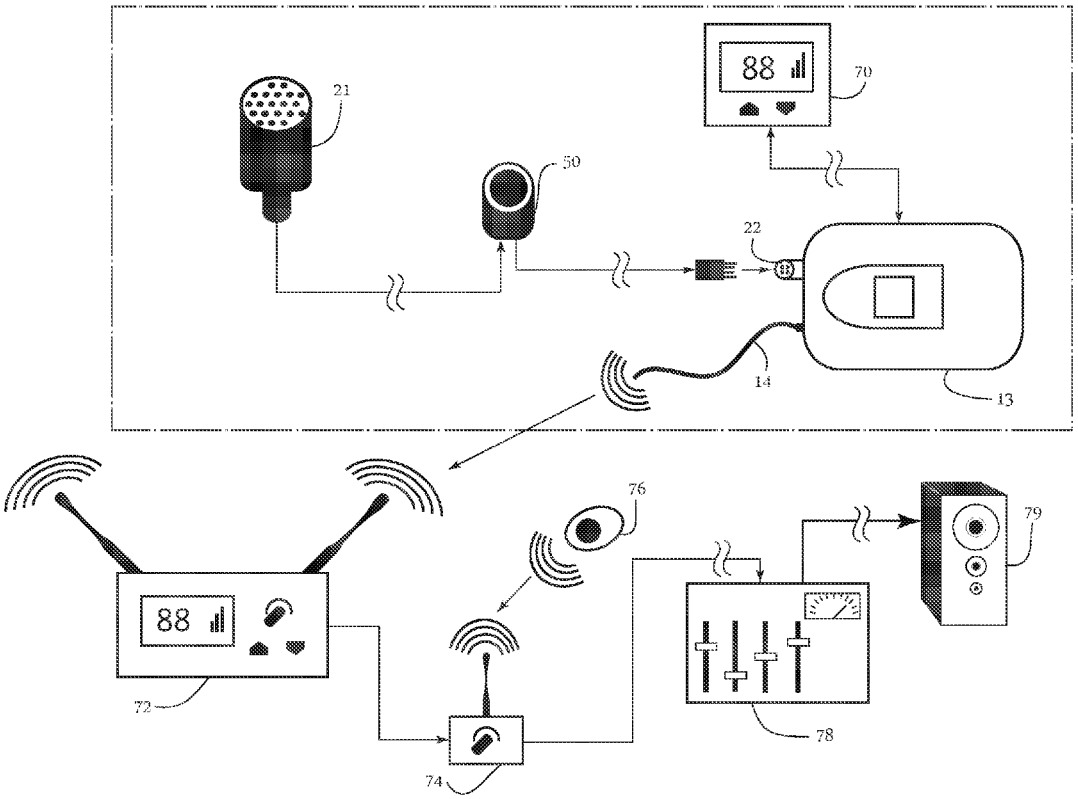
FIG. 8 is a schematic showing the connect between the electronic components of the mic ball 10 and the audio system with which it is to be used.

FIG. 8 is a schematic showing the interconnection between the mic ball's electronics and the audio system. Microphone 21 is hardwired to push to talk button 50 which connects to belt pack 12 by connector 22. Optional display and control 70 is hardwired to belt pack 13. Antenna 14 is connected to belt pack 13 for audio transmission to audio receiver 72. A wireless hand held mute button 76 can be operably interposed utilizing RF receiver 74 between the wireless receiver 72 and audio mixer/speaker 78/79 to enable the lecturer or professor to mute the microphone of the mic ball as desired.

The invention can also include a human interface device such as a touch pad or mouse to point or draw a sketch on a computer screen or projection device.

The foregoing description is not intended to limit the scope of the invention, but is intended only to provide examples of how this invention is constructed and operates. Other alternatives should be considered as being within the scope of the invention.

What is claimed:

1. A throwable microphone unit for facilitated transfer from user to user, including a wireless audio transmitting device adapted for use in a lecture hall, classroom, or auditorium with compatible audio speaker systems, to amplify what the user is saying, said unit comprising:

an outer enclosure having an interior for substantially surrounding and operably protecting said wireless audio transmitting device therewithin from being operationally affected by physical impact from throwing, said outer enclosure being constructed of a substantially resilient padding material;

said interior of said enclosure being operably associated with said transmitting device within said enclosure;

controls operably associated with transmitting device for allowing users to interact with the transmitting device from the exterior of said enclosure and, said enclosure and said wireless audio transmitting device providing for facilitated transfer of said enclosure and said device from user to user.

2. The throwable microphone unit of claim 1 wherein said unit further comprises:

a wireless controller operably associated with said unit for someone other than the user to selectively remotely activate and deactivate said transmitting device.

3. The throwable microphone unit of claim 1 wherein said unit further comprises one or more of the following items: an audio recorder for recording of the comments of the user; an RF mute button operably associated with said transmitting device: voice activated transmission of the transmission device; an RFID security tag; a laser pointer; use of rechargeable batteries; a non-round enclosure shape; and surface mounted display and controls.

4. The throwable microphone unit of claim 1 wherein said unit further comprises:

a protective skin substantially surrounding the outer periphery of said outer enclosure.

5. The throwable microphone unit of claim 1 wherein said substantially resilient padding material substantially surrounds said transmitting device.

6. The throwable microphone unit of claim 1 wherein said substantially resilient padding material comprises a foam material.

7. The throwable microphone unit of claim 1 wherein said substantially resilient padding material comprises a solid foam material.

8. The throwable microphone unit of claim 1 wherein said substantially resilient material comprises a granular foam material.

9. The throwable microphone unit of claim 4, further comprising a re-sealable aperture disposed through said outer protective skin, said re-sealable aperture providing exterior access to said outer enclosure through said aperture from outside of the protective skin.

10. The throwable microphone unit of claim 4 wherein at least one of said enclosure and said protective skin is disposed in a substantially bilaterally symmetrical manner about said transmitting device.

11. The throwable microphone unit of claim 1 wherein said enclosure is disposed in a substantially bilaterally symmetrical manner about said transmitting device.

12. The throwable microphone unit of claim 4 wherein said protective skin is disposed in a substantially bilaterally symmetrical manner about said transmitting device.

13. The throwable microphone unit of claim 1, further comprising a laser pointer substantially disposed within the enclosure.

14. A throwable microphone unit for facilitated transfer from user to user, including a wireless audio transmitting device adapted for use in a lecture hall, classroom, or auditorium with compatible audio speaker systems, to amplify what the user is saying, said unit comprising:

an enclosure substantially surrounding and operably protecting said wireless audio transmitting device from being operationally affected by physical impact from throwing, said enclosure being constructed of a substantially resilient padding material;

controls operably associated with transmitting device for allowing users to interact with the transmitting device from the exterior of said enclosure and, said enclosure and said wireless audio transmitting device providing for facilitated transfer of said enclosure and said device from user to user.

15. The throwable microphone unit of claim 14 wherein the unit further comprises:

a wireless controller operably associated with the unit for someone other than the user to selectively remotely activate and deactivate said transmitting device.

16. The throwable microphone unit of claim 14 wherein the substantially resilient padding material substantially surrounds the transmitting device.

17. The throwable microphone unit of claim 14 wherein the substantially resilient padding material comprises a foam material.

18. The throwable microphone unit of claim 14 wherein the substantially resilient padding material comprises a solid foam material.

19. The throwable microphone unit of claim 14 wherein the substantially resilient material comprises a granular foam material.

* * * * *